US011024241B2

(12) United States Patent
Lee et al.

(10) Patent No.: US 11,024,241 B2
(45) Date of Patent: Jun. 1, 2021

(54) TIMING CONTROLLER AND DISPLAY DEVICE INCLUDING THE SAME

(71) Applicant: SAMSUNG DISPLAY CO., LTD., Yongin-si (KR)

(72) Inventors: Hyun Dae Lee, Yongin-si (KR); Seung Hyun Moon, Yongin-si (KR); Dong Wook Yang, Yongin-si (KR); Bit Na Lee, Yongin-si (KR); Hee Chul Hwang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/390,907

(22) Filed: Apr. 22, 2019

(65) Prior Publication Data

US 2020/0098323 A1 Mar. 26, 2020

(30) Foreign Application Priority Data

Sep. 21, 2018 (KR) ..... 10-2018-0114176

(51) Int. Cl.
*G09G 3/36* (2006.01)

(52) U.S. Cl.
CPC ..... *G09G 3/3607* (2013.01); *G09G 2310/08* (2013.01); *G09G 2320/0666* (2013.01)

(58) Field of Classification Search
CPC ..... G09G 3/3607; G09G 2310/08; G09G 2320/0666
See application file for complete search history.

(56) References Cited

U.S. PATENT DOCUMENTS 7,030,846 B2 * 4/2006 Lee ..... G09G 3/3607 345/690
9,159,258 B2 10/2015 Lee
9,697,765 B2 7/2017 Chung et al.
10,121,408 B2 11/2018 Deng
2007/0091041 A1 * 4/2007 Chung ..... G09G 3/006 345/88
2007/0241989 A1 * 10/2007 Kim ..... G09G 3/3648 345/3.1
2010/0053185 A1 * 3/2010 Hwang ..... G09G 3/3611 345/556
2010/0156948 A1 * 6/2010 Kim ..... G09G 5/04 345/690
2010/0156951 A1 * 6/2010 Park ..... G09G 3/3648 345/690
2010/0315449 A1 * 12/2010 Chaji ..... G09G 3/2003 345/690
2012/0133835 A1 * 5/2012 Van Heesch ..... G09G 5/00 348/576
2014/0055500 A1 * 2/2014 Lai ..... G09G 3/3225 345/690

(Continued)

*Primary Examiner* — Ariel A Balaoing
(74) *Attorney, Agent, or Firm* — F. Chau & Associates, LLC

(57) ABSTRACT

A timing controller may include a first compensator configured to generate second data by optically compensating for first data, based on compensation data, a first compensation memory configured to store the compensation data, a second compensator configured to generate image data by compensating for a lifetime of the second data, based on accumulated data of the second data, and a second compensation memory configured to store the accumulated data and the compensation data.

11 Claims, 11 Drawing Sheets

(56) References Cited

U.S. PATENT DOCUMENTS

| | | | | |
|---|---|---|---|---|
| 2016/0005365 | A1* | 1/2016 | Choi | G09G 3/2007 345/690 |
| 2017/0154577 | A1* | 6/2017 | Lee | G09G 3/3233 |
| 2018/0322829 | A1* | 11/2018 | Xie | G09G 3/3233 |
| 2020/0118498 | A1* | 4/2020 | Lee | G09G 3/3275 |

* cited by examiner

FIG. 5B

[2-POINT COMPENSATION]

| | | | | | |
|---|---|---|---|---|---|
| RGR1_r | RCV1_r | RGR1_g | RCV1_g | RGR1_b | RCV1_b |
| RGR2_r | RCV2_r | RGR2_g | RCV2_g | RGR2_b | RCV2_b |
| GR1_r | CV1_r | GR1_g | CV1_g | GR1_b | CV1_b |
| GR2_r | CV2_r | GR2_g | CV2_g | GR2_b | CV2_b |

[3-POINT COMPENSATION]

| | | | | | |
|---|---|---|---|---|---|
| RGR1_r | RCV1_r | RGR1_g | RCV1_g | RGR1_b | RCV1_b |
| RGR2_r | RCV2_r | RGR2_g | RCV2_g | RGR2_b | RCV2_b |
| GR1_r | CV1_r | GR1_g | CV1_g | GR1_b | CV1_b |
| GR2_r | CV2_r | GR2_g | CV2_g | GR2_b | CV2_b |
| GR3_r | CV3_r | GR3_g | CV3_g | GR3_b | CV3_b |

TIMING CONTROLLER AND DISPLAY DEVICE INCLUDING THE SAME

CROSS-REFERENCE TO RELATED APPLICATION

The present application claims priority under 35 U.S.C. § 119 to Korean Patent Application No. 10-2018-0114176, filed on Sep. 21, 2018 in the Korean Intellectual Property Office, the entire disclosure of which is incorporated by reference herein in its entirety.

TECHNICAL FIELD

Exemplary embodiments of the inventive concept relate to a timing controller and a display device including the same.

DISCUSSION OF RELATED ART

Due to the growing importance of display devices as a connection medium between users and information, the use of various display devices, such as liquid crystal display (LCD) devices and organic light-emitting display devices, has increased.

Display devices may display a target image to users by applying a data voltage capable of expressing a target gray level to each pixel, and either allowing an organic light-emitting diode of the pixel to emit light in response to the data voltage or polarizing the light of a backlight by controlling liquid crystal alignment in response to the data voltage.

To prevent spots from being formed on a display image, a display device may use compensation data stored in a memory to optically compensate for image data received from an external device. Such compensation data may be written to the memory after a module of the display device has been completed. Furthermore, to compensate for changes in emission characteristics of light emitting elements or the like over time, the display device may use accumulated data obtained by accumulating image data received from the external device, thus making it possible to compensate for the lifetime of the image data.

SUMMARY

According to an exemplary embodiment of the inventive concept, a timing controller may include a first compensator configured to generate second data by optically compensating for first data, based on compensation data, a first compensation memory configured to store the compensation data, a second compensator configured to generate image data by compensating for a lifetime of the second data, based on accumulated data of the second data, and a second compensation memory configured to store the accumulated data and the compensation data.

In an exemplary embodiment of the inventive concept, the timing controller may further include a memory controller configured to set, in the first compensation memory, a first compensation data storage area for storing the compensation data, and set, in the second compensation memory, a second compensation data storage area for storing the compensation data and an accumulated data storage area for storing the accumulated data.

In an exemplary embodiment of the inventive concept, the compensation data may include a gray level and a compensation value for at least one compensation point.

In an exemplary embodiment of the inventive concept, the memory controller may reduce the second compensation data storage area as the accumulated data storage area increases.

In an exemplary embodiment of the inventive concept, the memory controller may reduce the number of bits of the compensation value as the accumulated data storage area increases.

In an exemplary embodiment of the inventive concept, the memory controller may delete a least significant bit of the bits indicating the compensation value.

In an exemplary embodiment of the inventive concept, the accumulated data storage area may increase as time passes.

In an exemplary embodiment of the inventive concept, the second compensator may generate the accumulated data by accumulating the second data.

In an exemplary embodiment of the inventive concept, when a preset point in time has come after a predetermined time has passed, the memory controller may set only the accumulated data storage area in the second compensation memory.

In an exemplary embodiment of the inventive concept, at least one of the first compensation memory and the second compensation memory may be a static random access memory (SRAM).

According to an exemplary embodiment of the inventive concept, a display device may include pixels disposed on intersections between scan lines and data lines, a scan driver configured to supply scan signals to the scan lines, a data driver configured to supply data signals to the data lines based on image data, and a timing controller configured to transmit the image data to the data driver. The timing controller may include a first compensator configured to generate second data by optically compensating for first data, based on compensation data, a first compensation memory configured to store the compensation data, a second compensator configured to generate the image data by compensating for a lifetime of the second data, based on accumulated data of the second data, and a second compensation memory configured to store the accumulated data and the compensation data.

In an exemplary embodiment of the inventive concept, the display device may further include a memory controller configured to set, in the first compensation memory, a first compensation data storage area for storing the compensation data, and set, in the second compensation memory, a second compensation data storage area for storing the compensation data and an accumulated data storage area for storing the accumulated data.

In an exemplary embodiment of the inventive concept, the compensation data may include a gray level and a compensation value for at least one compensation point.

In an exemplary embodiment of the inventive concept, the memory controller may reduce the second compensation data storage area as the accumulated data storage area increases.

In an exemplary embodiment of the inventive concept, the memory controller may reduce the number of bits of the compensation value as the accumulated data storage area increases.

According to an exemplary embodiment of the inventive concept, in a method of driving a display device including a memory controller and a first compensator, the method may include performing, by the first compensator, an optical compensation operation on first data using a 3-point compensation scheme to generate second data, based on compensation data including a plurality of bits, deleting, by the memory controller, at least one bit among the plurality of bits of the compensation data, performing, by the first compensator, the optical compensation operation on the first data using a 2-point compensation scheme to generate the second data, based on the compensation data after the at least one bit is deleted.

In an exemplary embodiment of the inventive concept, the display device may further include a second compensator, and the method may further include generating, by the second compensator, accumulated data by accumulating the second data, and compensating, by the second compensator, for a lifetime of the second data to generate image data, based on the accumulated data.

In an exemplary embodiment of the inventive concept, the display device may further include a first compensation memory configured to store the compensation data and a second compensation memory configured to store the compensation data and the accumulated data.

In an exemplary embodiment of the inventive concept, the second compensation memory area may include a compensation data storage area for storing the compensation data and an accumulated data storage area for storing the accumulated data, and when the at least one bit is deleted, the compensation data storage area is reduced and the accumulated data storage area is increased.

In an exemplary embodiment of the inventive concept, the at least one bit may include two or more bits.

BRIEF DESCRIPTION OF THE DRAWINGS

The above and other features of the inventive concept will be more clearly understood by describing in detail exemplary embodiments thereof with reference to the accompanying drawings.

FIGS. 5A and 5B are diagrams illustrating compensation data for optical compensation of the display device of FIG. 1 in accordance with exemplary embodiments of the inventive concept.

DETAILED DESCRIPTION OF THE EMBODIMENTS

Figure 1:
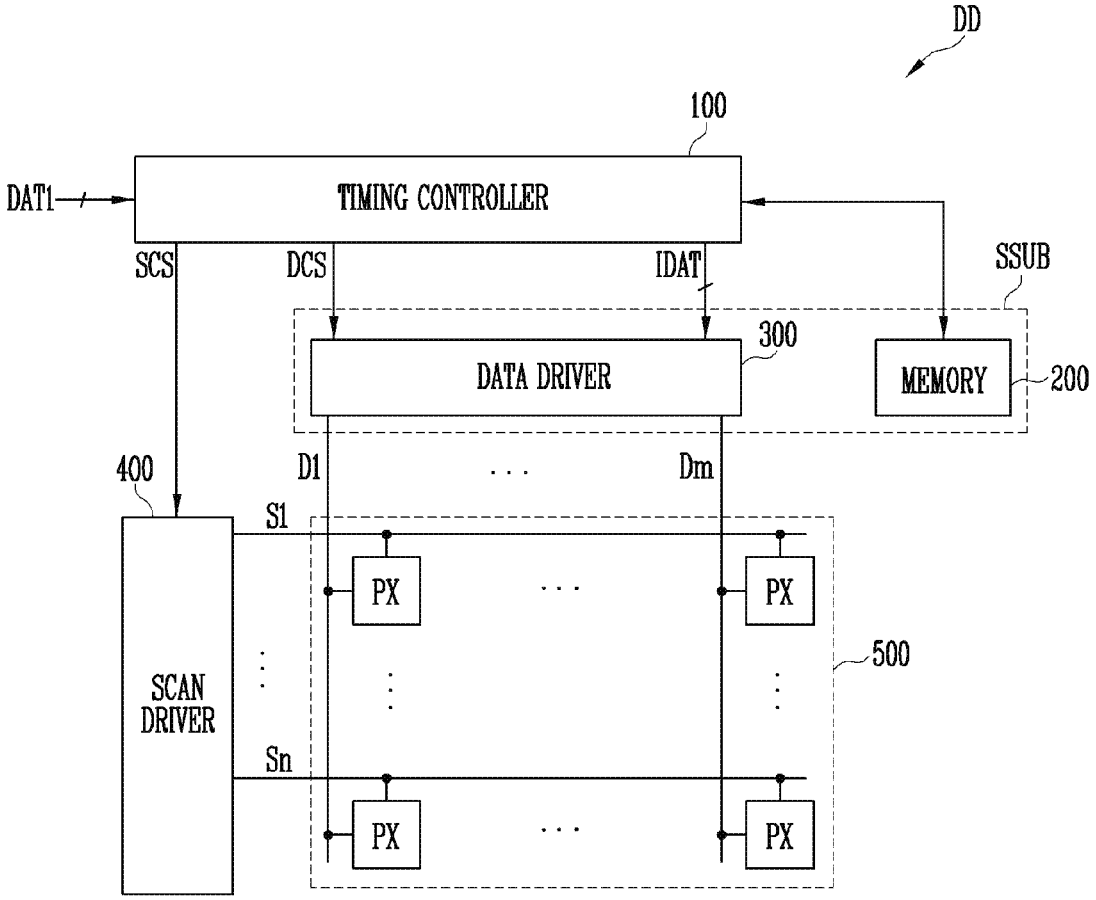
FIG. 1 is a diagram illustrating a display device in accordance with an exemplary embodiment of the inventive concept.

Exemplary embodiments of the inventive concept are directed to a timing controller and a display device including the same capable of enhancing the precision of optical compensation under conditions in which memory capacity is limited.

Exemplary embodiments of the inventive concept will be described more fully hereinafter with reference to the accompanying drawings. Like reference numerals may refer to like elements throughout this application.

In this specification, "connected/coupled" refers to one component not only directly coupling another component but also indirectly coupling another component through an intermediate component.

FIG. 1 is a diagram illustrating a display device in accordance with an exemplary embodiment of the inventive concept.

Referring to FIG. 1, a display device DD may include a timing controller 100, a memory 200, a data driver 300, a scan driver 400, and a pixel unit 500.

The timing controller 100 may control overall operations of the display device DD.

In detail, the timing controller 100 may receive first data DAT1 and external control signals from an external device. For example, the first data DAT1 may refer to an image received from the external device. The external control signals may include a vertical synchronization signal, a horizontal synchronization signal, a main clock signal, a data enable signal, and so forth.

The timing controller 100 may communicate with the memory 200 through a separate interface. For example, the separate interface may refer to a serial programming interface (SPI) communication scheme. The SPI communication scheme may be a serial communication device or serial communication scheme by which a processor and a peripheral integrated circuit (IC) communicate with each other. The timing controller 100 may read compensation data from the memory 200.

The timing controller 100 may optically compensate for input data (e.g., the first data DAT1) based on the compensation data. For example, the compensation data may include respective spot compensation values of pixels PX. The timing controller 100 may generate accumulated data obtained by accumulating optically-compensated data, and compensate for the lifetime of the optically-compensated data based on the accumulated data.

The timing controller 100 may generate image data IDAT by optically compensating for the first data DAT1 or compensating for the lifetime of the first data DAT1. The timing controller 100 may generate a data driving control signal DCS and a scan driving control signal SCS, based on at least one of the first data DAT1 and the external control signals. The image data IDAT, the data driving control signal DCS, and the scan driving control signal SCS may be suitable for operation conditions of the data driver 300, the scan driver 400, and the pixel unit 500.

The timing controller 100 may transmit the image data IDAT and the data driving control signal DCS to the data driver 300.

The timing controller 100 may transmit the scan driving control signal SCS to the scan driver 400.

The memory 200 may store the compensation data. For example, the timing controller 100 may read the compensation data from the memory 200 through an interface (e.g., the above-described separate interface), and an external device may write the compensation data to the memory 200 through the interface. In an exemplary embodiment of the inventive concept, the memory 200 may be a flash memory.

The data driver 300 may receive the data driving control signal DCS and the image data IDAT from the timing controller 100. The data driver 300 may generate data signals, based on the data driving control signal DCS and the image data IDAT. The data driver 300 may supply data signals to data lines D1 to Dm (where m is a natural number). For example, the data driver 300 may supply the data signals to the data lines D1 to Dm in synchronization with a corresponding scan signal. The data signals supplied to the data lines D1 to Dm may be input to the pixels PX of a pixel line selected by the corresponding scan signal. In an exemplary embodiment of the inventive concept, the data driver 300 may include a plurality of data driving ICs. The memory 200 and the data driver 300 may be disposed on a source substrate SSUB (e.g., a source board).

The scan driver 400 may receive the scan driving control signal SCS from the timing controller 100. The scan driver 400 may generate scan signals based on the scan driving control signal SCS. The scan driver 400 may supply the scan signals to scan lines S1 to Sn (where n is a natural number). For example, the scan driver 400 may sequentially supply the scan signals to the scan lines S1 to Sn.

The pixel unit 500 may include a substrate, and the pixels PX disposed on the substrate. For example, the pixel unit 500 may refer to a display area of a display panel.

The pixels PX may be coupled with the corresponding data lines D1 to Dm and the corresponding scan lines S1 to Sn, and may be supplied with the data signals and the scan signals through the data lines D1 to Dm and the scan lines S1 to Sn. The pixels PX may be disposed on intersections of the scan lines S1 to Sn and the data lines D1 to Dm. Each pixel PX may emit light at a gray level corresponding to a related data signal.

The pixel unit 500 may further include the scan lines S1 to Sn and the data lines D1 to Dm that are disposed on the substrate. In an exemplary embodiment of the inventive concept, the scan lines S1 to Sn may extend in a first direction (e.g., in a horizontal direction). The data lines D1 to Dn may extend in a second direction (e.g., in a vertical direction) different from the first direction. In an exemplary embodiment of the inventive concept, each of the pixels PX may be coupled to at least one of the scan lines S1 to Sn and coupled to at least one of the data lines D1 to Dm.

Although in FIG. 1, the pixel unit 500, the timing controller 100, the scan driver 400, and/or the data driver 300 has been illustrated as being a separate component, the inventive concept is not limited thereto. For example, at least two of the pixel unit 500, the timing controller 100, the scan driver 400, and the data driver 300 may be integrated with each other or mounted on the substrate of the pixel unit 500. For example, the pixel unit 500 may be a display panel.

Figure 2:
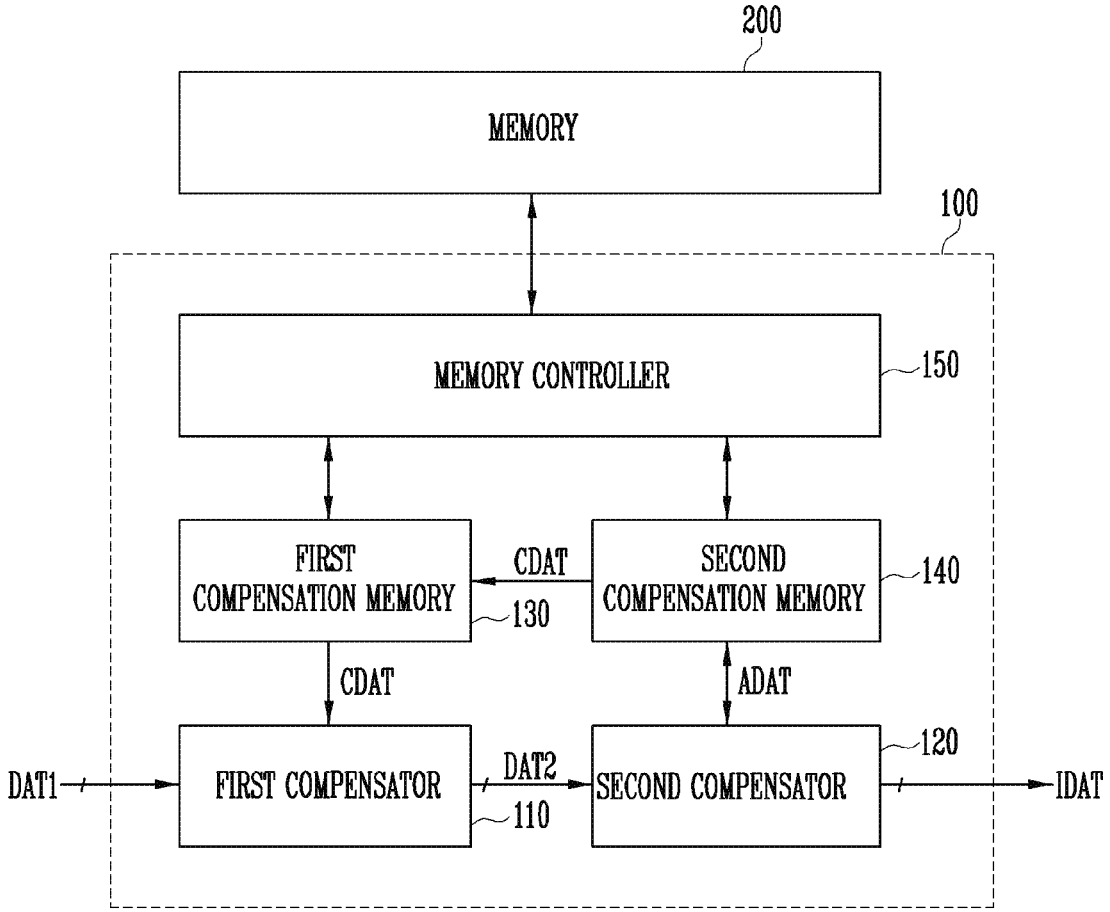
FIG. 2 is a diagram illustrating a timing controller of FIG. 1 in accordance with an exemplary embodiment of the inventive concept.

FIG. 2 is a diagram illustrating a timing controller of FIG. 1 in accordance with an exemplary embodiment of the inventive concept.

Referring to FIG. 2, the timing controller 100 may include a first compensator 110, a second compensator 120, a first compensation memory 130, a second compensation memory 140, and a memory controller 150.

The first compensator 110 may receive the first data DAT1. The first compensator 110 may read compensation data CDAT stored in the first compensation memory 130 and the second compensation memory 140. The first compensator 110 may optically compensate for the first data DAT1, based on the compensation data CDAT. The first compensator 110 may generate second data DAT2 by optically compensating for the first data DAT1. The first compensator 110 may transmit the second data DAT2 to the second compensator 120.

The second compensator 120 may receive the second data DAT2. The second compensator 120 may generate accumulated data ADAT by accumulating the second data DAT2. The second compensator 120 may write the accumulated data ADAT to the second compensation memory 140.

The second compensator 120 may read the accumulated data ADAT stored in the second compensation memory 140. The second compensator 120 may compensate for the lifetime of the second data DAT2, based on the accumulated data ADAT. The second compensator 120 may generate image data IDAT by compensating for the lifetime of the second data DAT2.

The first compensation memory 130 may store the compensation data CDAT. The second compensation memory 140 may store at least one of the compensation data CDAT and the accumulated data ADAT. In an exemplary embodiment of the inventive concept, at least one of the first compensation memory 130 and the second compensation memory 140 may be a static random access memory (SRAM).

The memory controller 150 may set, in the first compensation memory 130, a first compensation data storage area for storing the compensation data CDAT.

The memory controller 150 may set, in the second compensation memory 140, a second compensation data storage area for storing the compensation data CDAT and an accumulated data storage area for storing the accumulated data ADAT.

Furthermore, the memory controller 150 may communicate with the memory 200 through the interface. The memory controller 150 may read data stored in the memory 200, or write data to the memory 200. For example, the compensation data CDAT may also be stored in the memory 200.

Figure 3:
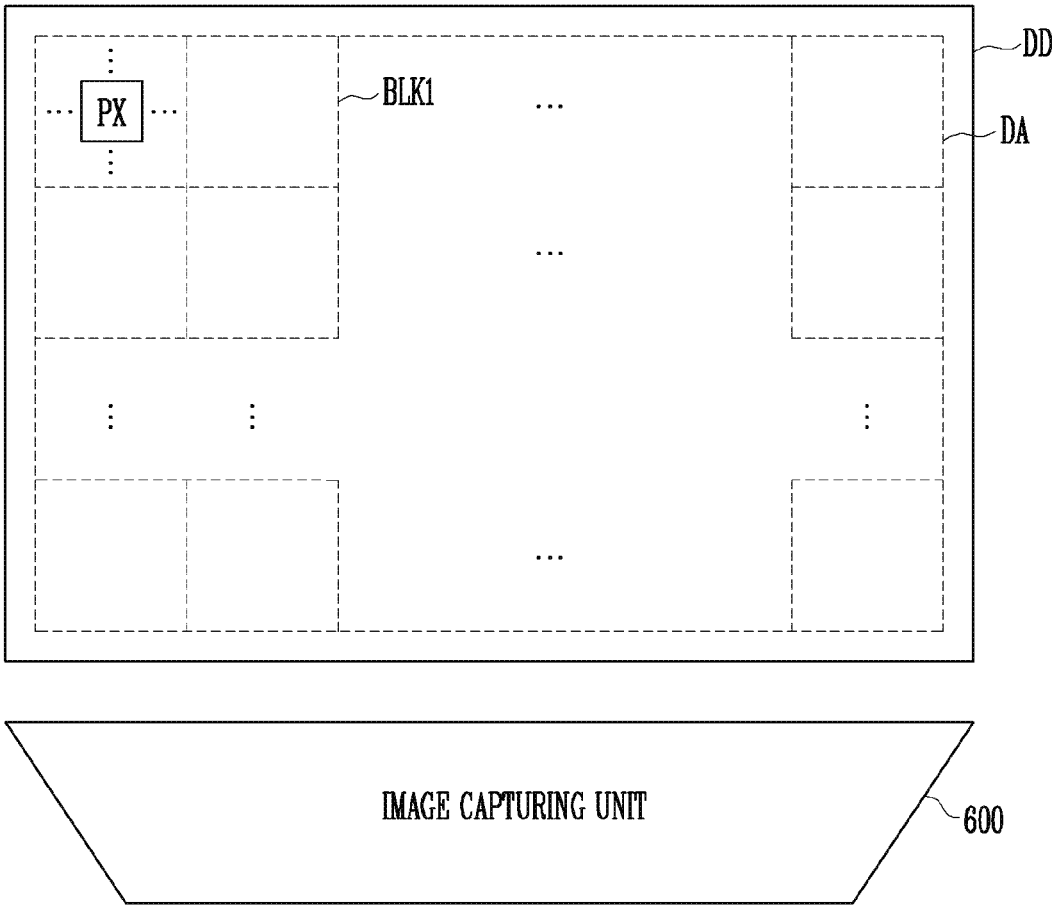
FIG. 3 is a diagram illustrating an operation of generating compensation data in the display device of FIG. 1 in accordance with an exemplary embodiment of the inventive concept.

FIG. 3 is a diagram illustrating an operation of generating compensation data in the display device of FIG. 1 in accordance with an exemplary embodiment of the inventive concept. In more detail, FIG. 3 is a diagram illustrating the operation of capturing a display surface DA of the display device DD to generate compensation data, in accordance with an exemplary embodiment of the inventive concept.

Referring to FIG. 3, the display device DD may include the display surface DA. For example, the display surface DA may refer to a front surface of the display device DD, and correspond to the pixel unit 500 shown in FIG. 1.

The pixels PX may be arranged on the display surface DA. The contents described with reference to FIG. 1 may be applied to detailed contents pertaining to the arrangement of the pixels PX of FIG. 3.

The pixels PX may be grouped into first blocks BLK1. In other words, each first block BLK1 may include a plurality of pixels PX.

An image capturing unit 600 may capture an image of the display surface DA of the display device DD. Here, the display device DD may display an image having a predetermined pattern through the display surface DA. The image capturing unit 600 may measure light emitted from the pixels PX by capturing the image of the display surface DA.

For example, the image capturing unit 600 may measure the luminance of the display surface DA.

The image capturing unit 600 may measure the luminance for each first block BLK1. The image capturing unit 600 may generate luminance data based on the measured luminance.

Referring to FIGS. 2 and 3, the compensation data CDAT may be generated for each first block BLK1, based on the luminance data.

However, the inventive concept is not limited thereto. In exemplary embodiments of the inventive concept, the compensation data CDAT may be generated for each pixel PX.

Figure 4:
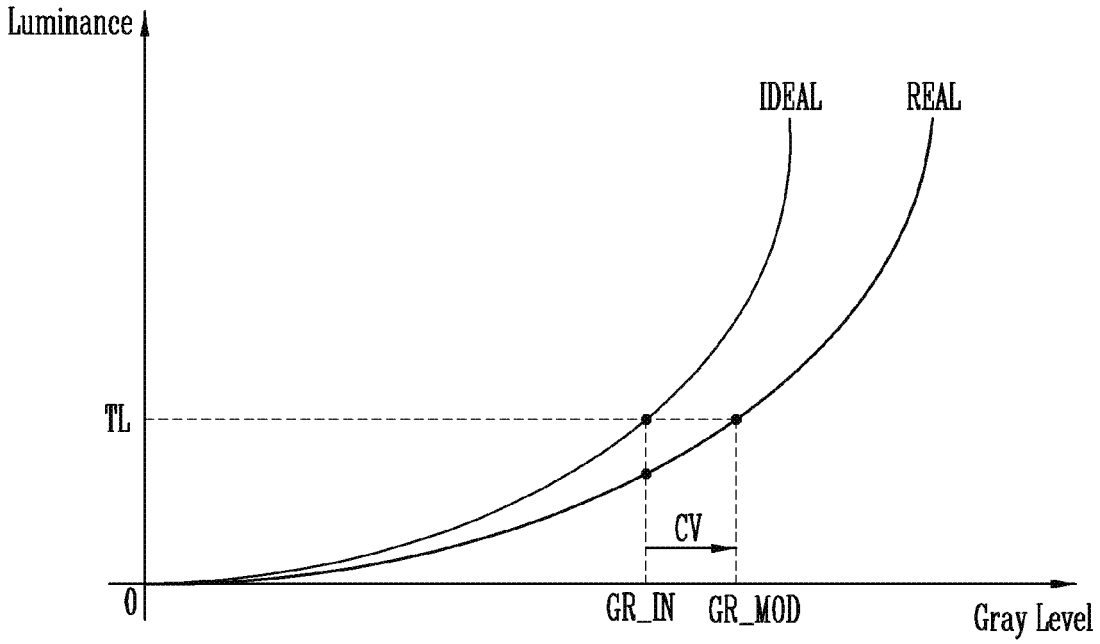
FIG. 4 is a diagram illustrating an operation of calculating a compensation value for optical compensation in accordance with an exemplary embodiment of the inventive concept.

FIG. 4 is a diagram illustrating an operation of calculating a compensation value for optical compensation in accordance with an exemplary embodiment of the inventive concept. FIG. 4 illustrates a graph having an x-axis indicating a gray level and a y-axis indicating luminance. FIGS. 3 and 4 illustrate an ideal luminance curve IDEAL and a real luminance curve REAL.

A luminance as a function of an input gray level GR_IN may be, ideally, a target luminance TL. However, practically, a luminance as a function of the input gray level GR_IN may be lower than the target luminance TL. For example, the luminance difference between the ideal case and the real case may occur due to characteristics of a light emitting element, a driving transistor, or the like.

Therefore, to obtain the target luminance TL, the input gray level GR_IN may be changed to a modified gray level GR_MOD. Here, a difference between the input gray level GR_IN and the modified gray level GR_MOD may be referred to as a compensation value CV. The compensation value CV may vary depending on each gray level.

In an exemplary embodiment of the inventive concept, the real luminance curve REAL may vary depending on the RGB colors.

Figure 5A:
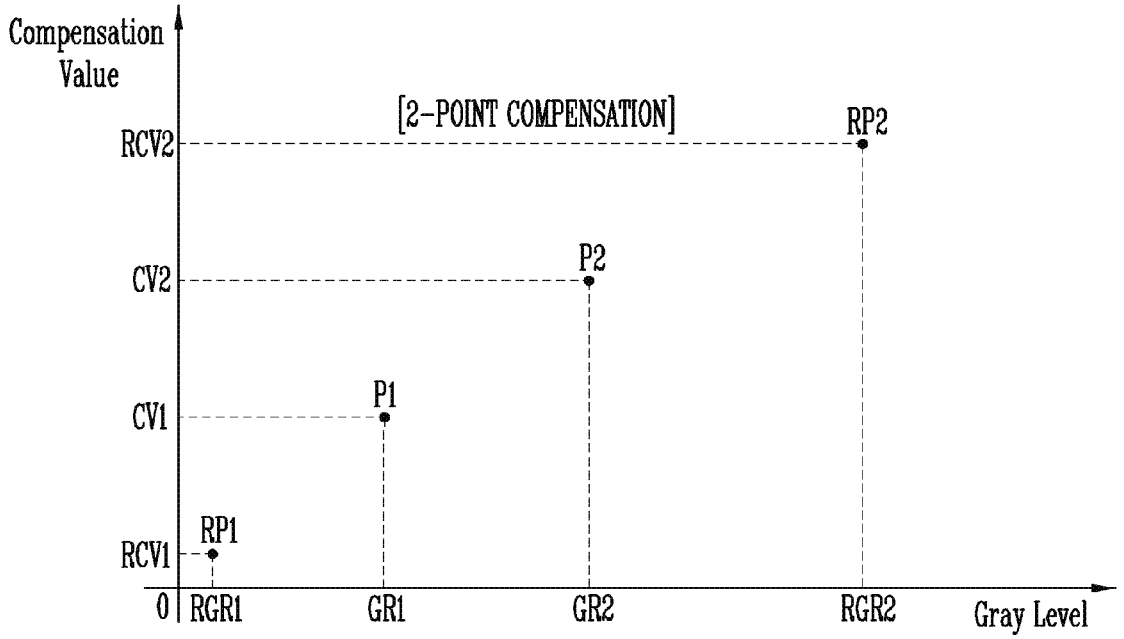
Figure 5A:
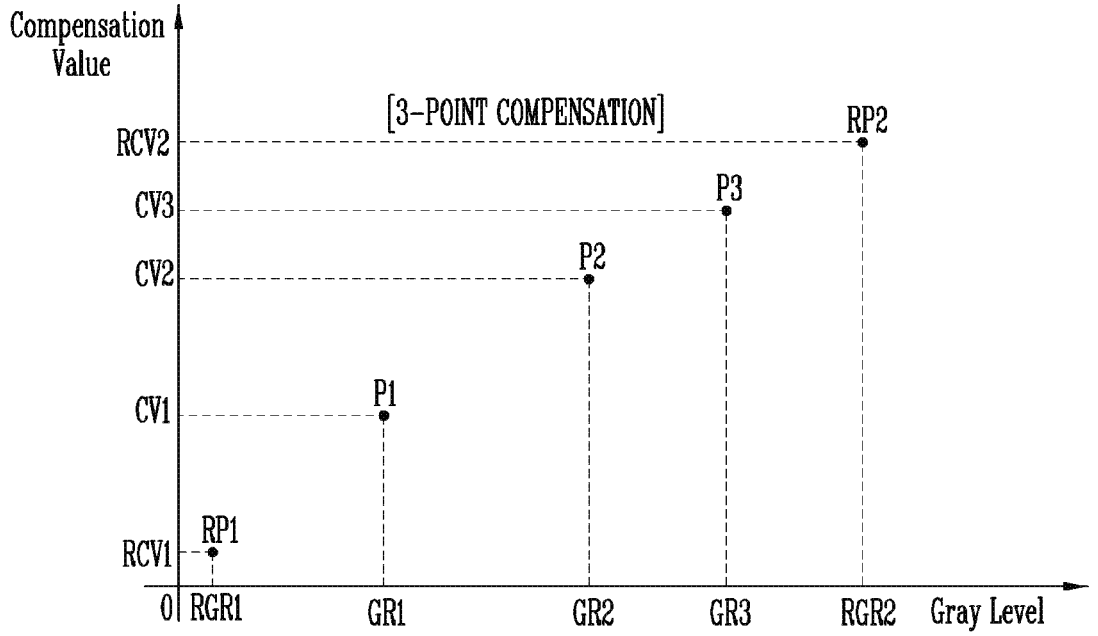

FIGS. 5A and 5B are diagrams illustrating compensation data for optical compensation of the display device of FIG. 1 in accordance with exemplary embodiments of the inventive concept.

Referring to FIGS. 2 to 5B, the first compensator 110 may perform an optical compensation operation in a 2-point compensation scheme or a 3-point compensation scheme.

Hereinafter, the 2-point compensation scheme will be first described.

Due to limitation in capacity of the memory, compensation values for gray levels (e.g., gray levels 0 to 255) may be selectively calculated.

First, a first reference compensation value RCV1 and a second reference compensation value RCV2 may be respectively calculated for a first reference gray level RGR1 (e.g., a minimum gray level) and a second reference gray level RGR2 (e.g., a maximum gray level).

As shown in the first graph of FIG. 5A, a first reference point RP1 may correspond to the first reference gray level RGR1 and the first reference compensation value RCV1, and a second reference point RP2 may correspond to the second reference gray level RGR2 and the second reference compensation value RCV2.

Thereafter, a first gray level GR1 and a second gray level GR2 which are positioned between the first reference gray level RGR1 and the second reference gray level RGR2 may be selected. Subsequently, a first compensation value CV1 and a second compensation value CV2 may be respectively calculated for the first gray level GR1 and the second gray level GR2. As shown in the drawings, a first point P1 may correspond to the first gray level GR1 and the first compensation value CV1, and a second point P2 may correspond to the second gray level GR2 and the second compensation value CV2.

In an exemplary embodiment of the inventive concept, the first reference gray level RGR1 may be gray level 0, and the second reference gray level RGR2 may be gray level 255.

FIG. 5B illustrates the structure of compensation data in accordance with an exemplary embodiment of the inventive concept.

As shown in the first table of FIG. 5B, the above-mentioned gray levels RGR1, RGR2, GR1, and GR2 and the above-mentioned compensation values RCV1, RCV2, CV1, and CV2 may be set and stored according to each of the RGB colors.

Hereinafter, the 3-point compensation scheme will be described. To avoid redundant description, the following description will be focused on differences from the 2-point compensation scheme.

Compared to the 2-point compensation scheme, the 3-point compensation scheme may further select a third gray level GR3, and further calculate a third compensation value CV3 for the third gray level GR3. As shown in the second graph of FIG. 5A, a third point P3 may correspond to the third gray level GR3 and the third compensation value CV3.

As shown in the second table of FIG. 5B, the above-mentioned gray levels RGR1, RGR2, GR1, GR2, and GR3 and the above-mentioned compensation values RCV1, RCV2, CV1, CV2, and CV3 may be set and stored according to each of the RGB colors.

Figure 6:
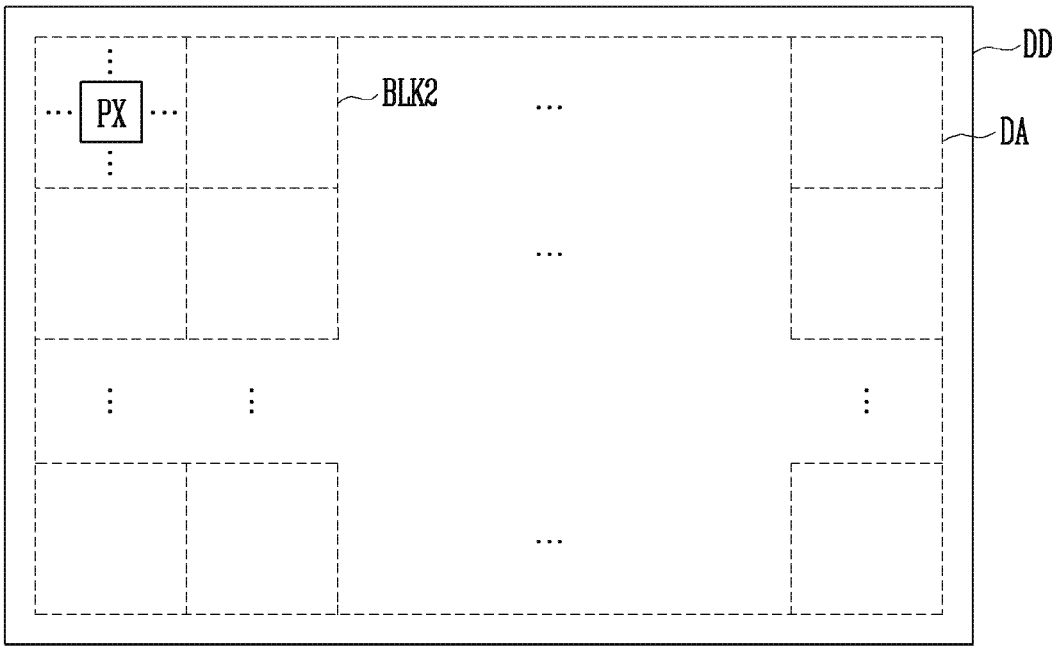
FIG. 6 is a diagram illustrating an operation of generating accumulated data in the display device of FIG. 1 in accordance with an exemplary embodiment of the inventive concept.

FIG. 6 is a diagram illustrating an operation of generating accumulated data in the display device of FIG. 1 in accordance with an exemplary embodiment of the inventive concept.

Referring to FIG. 6, the display device DD may include the display surface DA. For example, the display surface DA may refer to a front surface of the display device DD, and correspond to the pixel unit 500 illustrated in FIG. 1.

The pixels PX may be arranged on the display surface DA. The contents described with reference to FIG. 1 may be applied to detailed contents pertaining to the arrangement of the pixels PX of FIG. 6.

The pixels PX may be grouped into second blocks BLK2. In other words, each second block BLK2 may include a plurality of pixels PX.

In an exemplary embodiment of the inventive concept, the second block BLK2 shown in FIG. 6 may be set in a manner different from that of the first block BLK1 illustrated in FIG. 3.

Referring to FIGS. 2 and 6, the second compensator 120 may accumulate the second data DAT2 on each second block BLK2. Therefore, the accumulated data ADAT may be generated for each second block BLK2. However, the inventive concept is not limited thereto. In exemplary embodiments of the inventive concept, the second compensator 120 may accumulate the second data DAT2 on each pixel PX. Here, the accumulated data ADAT may be generated for each pixel PX.

Figure 7:
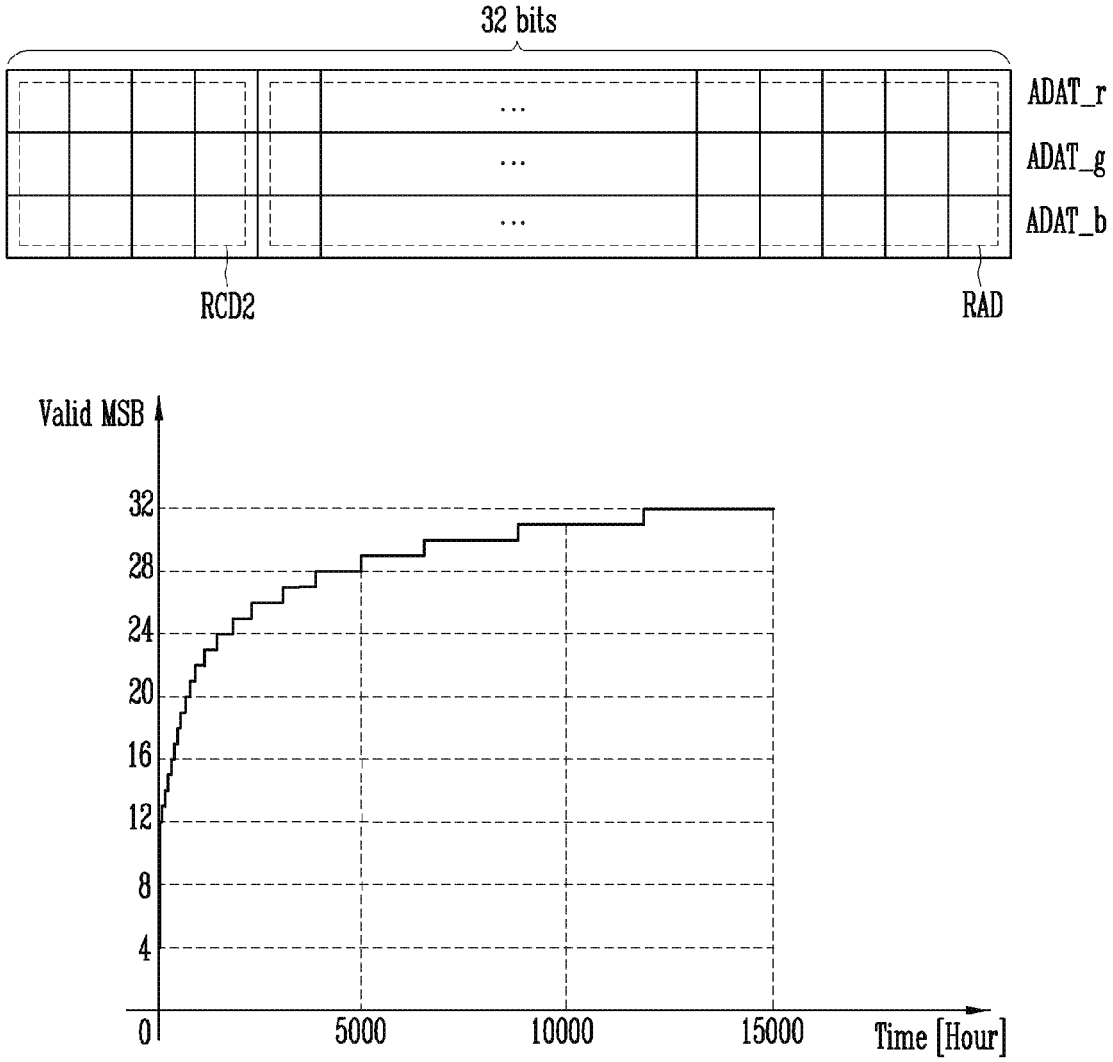
FIG. 7 is a diagram illustrating accumulated data of the display device of FIG. 1 in accordance with an exemplary embodiment of the inventive concept.

FIG. 7 is a diagram illustrating accumulated data of the display device of FIG. 1 in accordance with an exemplary embodiment of the inventive concept.

For the sake of explanation, FIG. 7 illustrates storage space allocated for accumulated data ADAT_r, ADAT_g, and ADAT_b with respect to one second block BLK2.

Referring to FIGS. 2 and 7, squares disposed on each horizontal line indicate respective bits of storage space allocated for a corresponding one of the accumulated data ADAT_r, ADAT_g, and ADAT_b corresponding to the respective RGB colors. For example, each of the accumulated data ADAT_r, ADAT_g, and ADAT_b may be stored in storage space having a maximum of 32 bits.

Referring to the graph of FIG. 7, as time passes, the valid most significant bit of each of the accumulated data ADAT_r, ADAT_g, and ADAT_b may gradually increase.

Therefore, as shown in the drawings, valid bits of the accumulated data ADAT_r, ADAT_g, and ADAT_b may not be stored in storage space allocated for significant bits until a substantial amount of time passes. For example, valid bits of the accumulated data ADAT_r, ADAT_g, and ADAT_b may not be stored in storage space allocated for four significant bits until 5000 hours passes.

Consequently, the memory controller 150 in accordance with an exemplary embodiment of the inventive concept may set a second compensation data storage area RCD2 in the second compensation memory 140 so as to reduce inefficiency in use of the memory for accumulated data and enhance the precision of the optical compensation. Here, the second compensation data storage area RCD2 may correspond to the storage space allocated for the significant bits. An accumulated data storage area RAD of FIG. 7 will be described in detail below with reference to FIG. 8.

Figure 8:
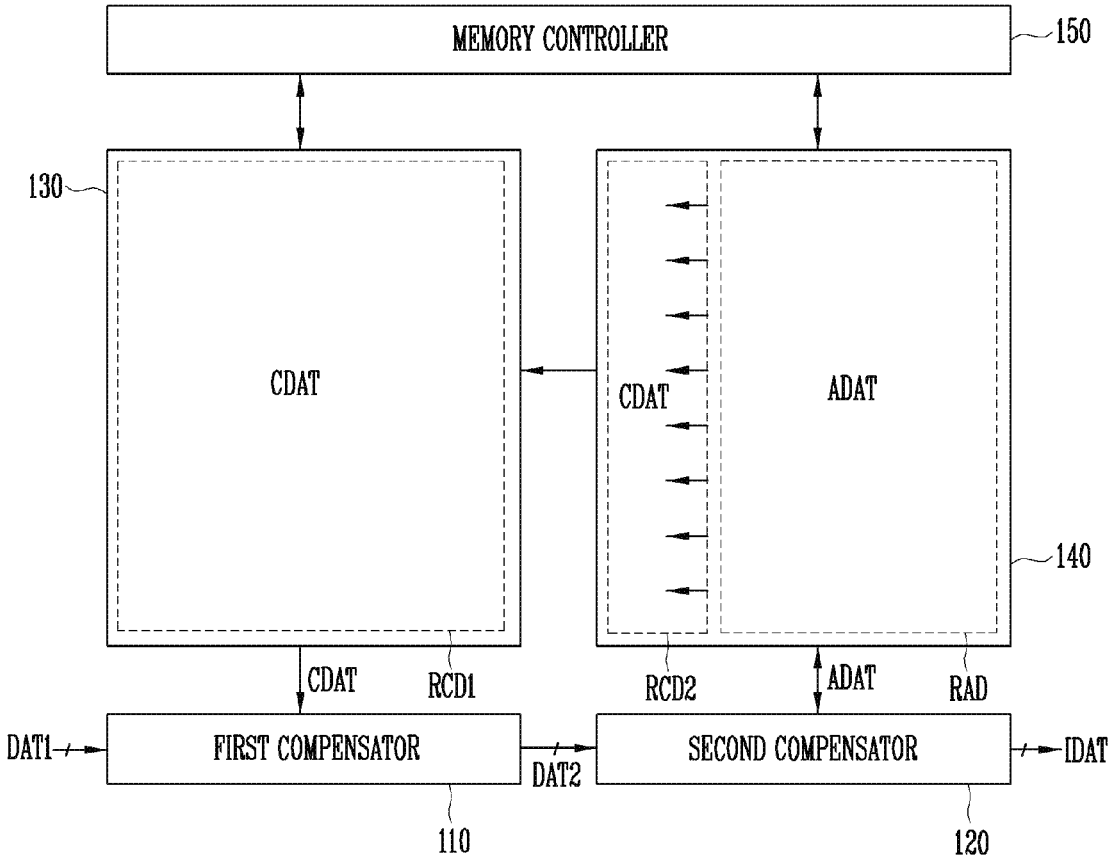
FIG. 8 is a diagram illustrating compensation memories of the display device of FIG. 1 in accordance with an exemplary embodiment of the inventive concept.

FIG. 8 is a diagram illustrating compensation memories of the display device of FIG. 1 in accordance with an exemplary embodiment of the inventive concept.

Referring to FIG. 8, the memory controller 150 may set, in the first compensation memory 130, a first compensation data storage area RCD1 for storing the compensation data CDAT.

The memory controller 150 may set, in the second compensation memory 140, the second compensation data storage area RCD2 for storing the compensation data CDAT and the accumulated data storage area RAD for storing the accumulated data ADAT.

The memory controller 150 may gradually reduce the second compensation data storage area RCD2 as the accumulated data storage area RAD increases. The accumulated data storage area RAD may increase over time.

During an initial driving period, the first compensation data storage area RCD1 and the second compensation data storage area RCD2 for storing the compensation data CDAT may be maximally secured. Therefore, the first compensator 110 may compensate for the first data DAT1 in the 3-point compensation scheme.

Since the second compensation data storage area RCD2 is reduced over time, the first compensator 110 may compensate for the first data DAT1 gradually in a scheme similar to the 2-point compensation scheme.

Figure 9:
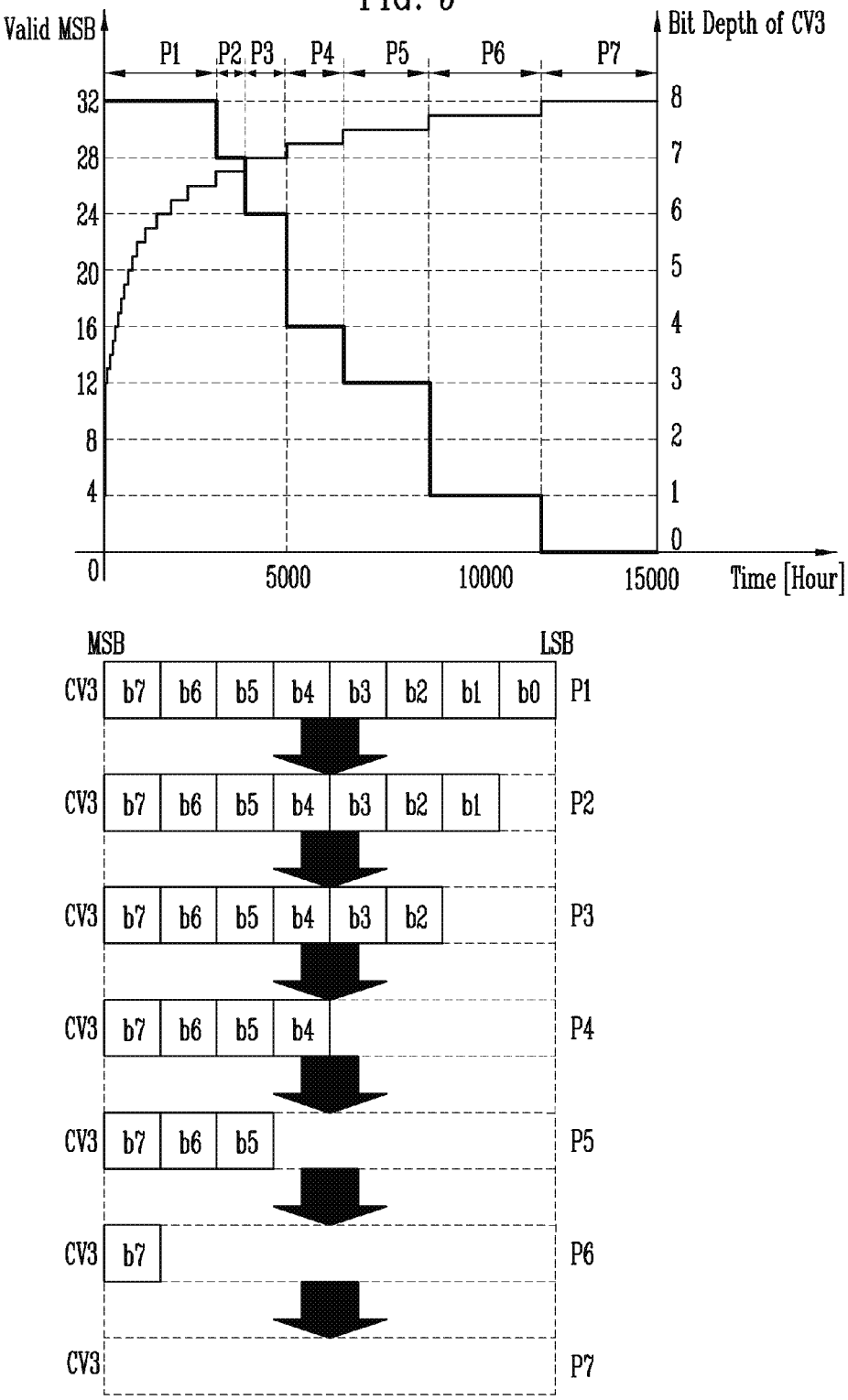
FIG. 9 is a diagram illustrating a method of driving a display device in accordance with an exemplary embodiment of the inventive concept.
Figure 10:
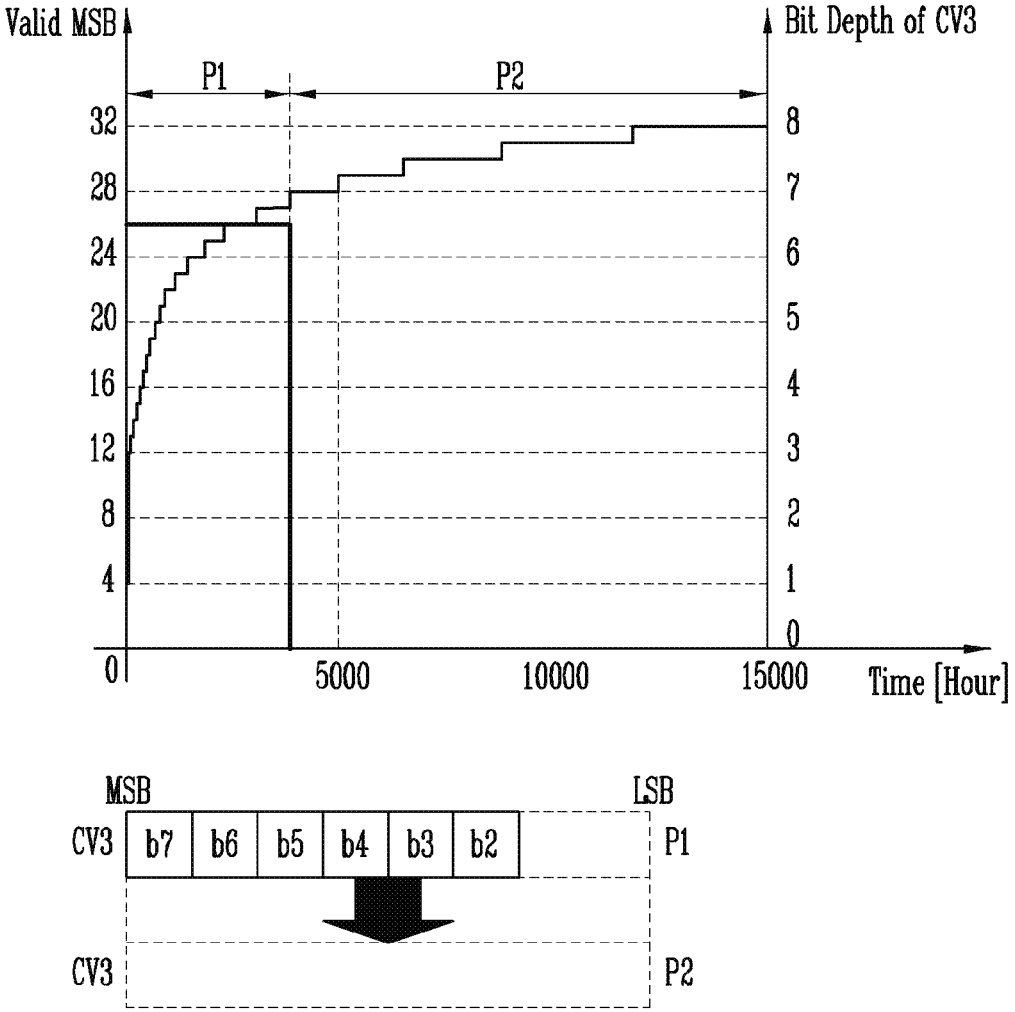
FIG. 10 is a diagram illustrating a method of driving a display device in accordance with an exemplary embodiment of the inventive concept.

FIG. 9 is a diagram illustrating a method of driving a display device in accordance with an exemplary embodiment of the inventive concept. FIG. 10 is a diagram illustrating a method of driving a display device in accordance with an exemplary embodiment of the inventive concept.

For the sake of explanation, FIGS. 9 and 10 illustrate that the third compensation value CV3 has 8 bits, but the inventive concept is not limited thereto.

Referring to FIGS. 5A to 9, the memory controller 150 may gradually reduce the second compensation data storage area RCD2 by gradually reducing the number of bits of the third compensation value CV3.

For example, during a first period P1 which is the initial driving period, the number of bits (b7 to b0) of the third compensation value CV3 may be eight.

Since all bits of the third compensation value CV3 remain intact, the first compensator 110 may perform an optical compensation operation in the 3-point compensation scheme during the first period P1.

Referring to the graph of FIG. 9, as time passes, the valid most significant bit of each of the accumulated data ADAT_r, ADAT_g, and ADAT_b may gradually increase. In other words, the accumulated data storage area RAD may gradually increase.

In a second period P2, the memory controller 150 may first delete the least significant bit of the bits B7 to B0 indicating the third compensation value CV3. In other words, if the second period P2 has come, the memory controller 150 may delete a first bit b0 which is the least significant bit of the third compensation value CV3.

In a third period P3, the memory controller 150 may delete a second bit b1.

In a fourth period P4, the memory controller 150 may delete a third bit b2 and a fourth bit b3.

In a fifth period P5, the memory controller 150 may delete a fifth bit b4.

In a sixth period P6, the memory controller 150 may delete a sixth bit b5 and a seventh bit b6.

During the second to sixth periods P2 to P6, the first compensator 110 may restore the third compensation value CV3 by arbitrarily setting the deleted bits. Here, the first compensator 110 may perform the optical compensation operation using the 3-point compensation scheme. However, compared to the case where all bits of the third compensation value CV3 remain intact, the optical compensation precision of the first compensator 110 may be reduced.

In a seventh period P7, the memory controller 150 may delete an eighth bit b7. In other words, if the seventh period P7 has come, the memory controller 150 may delete the third compensation value CV3. Here, the first compensator 110 may perform the optical compensation operation using the 2-point compensation scheme during the seventh period P7.

Therefore, the timing controller 100 and the display device DD in accordance with an exemplary embodiment of the inventive concept may enhance the precision of the optical compensation under conditions in which the capacity of the memory is limited.

Referring to FIGS. 5A to 10, the memory controller 150 may set only the accumulated data storage area RAD in the second compensation memory 140 when a preset point in time has come after a predetermined time has passed.

For example, during the first period P1 which is the initial driving period, the number of bits (b7 to b2) of the third compensation value CV3 may be six.

During the first period P1, since all of the bits of the third compensation value CV3 do not remain intact, the first compensator 110 may restore the third compensation value CV3 by arbitrarily setting the detected bits.

Here, the first compensator 110 may perform the optical compensation operation using the 3-point compensation scheme. However, compared to the case where all of the bits of the third compensation value CV3 remain intact, the optical compensation precision of the first compensator 110 may be reduced.

In the second period P2, the memory controller 150 may delete the bits b7 to b2 indicating the third compensation value CV3. In other words, if the second period P2 has come, the memory controller 150 may set only the accumulated data storage area RAD in the second compensation memory 140.

In other words, if the second period P2 has come, the memory controller 150 may delete the third compensation value CV3. Here, the first compensator 110 may perform the optical compensation operation using the 2-point compensation scheme during the second period P2.

In the exemplary embodiment of FIG. 10, a logic size (e.g., a circuit size) may be reduced as compared to the exemplary embodiment of FIG. 9.

Exemplary embodiments of the inventive concept may provide a timing controller and a display device including the same capable of enhancing the precision of optical compensation under conditions in which memory capacity is limited.

While the inventive concept has been particularly shown and described with reference to exemplary embodiments thereof, it will be understood by those of ordinary skill in the art that various changes in form and details may be made thereto without departing from the spirit and scope of the inventive concept as set forth by the following claims.

What is claimed is:

1. A timing controller comprising:

a first compensator configured to generate second data by optically compensating for first data, based on compensation data;

a first compensation memory configured to store the compensation data;

a second compensator configured to generate image data by compensating for a lifetime of the second data, based on accumulated data of the second data;

a second compensation memory configured to store the accumulated data and the compensation data; and a memory controller configured to set, in the first compensation memory, a first compensation data storage area for storing the compensation data, and set, in the second compensation memory, a second compensation data storage area for storing the compensation data and an accumulated data storage area for storing the accumulated data, wherein the memory controller reduces the second compensation data storage area as the accumulated data storage area increases.

2. The timing controller according to claim 1, wherein the compensation data includes a gray level and a compensation value for at least one compensation point.

3. The timing controller according to claim 2, wherein the memory controller reduces a number of bits of the compensation value as the accumulated data storage area increases.

4. The timing controller according to claim 3, wherein the memory controller deletes a least significant bit of the bits of the compensation value.

5. The timing controller according to claim 4, wherein the accumulated data storage area increases as time passes.

6. The timing controller according to claim 1, wherein the second compensator generates the accumulated data by accumulating the second data.

7. The timing controller according to claim 1, wherein, when a preset point in time has come after a predetermined time has passed, the memory controller sets only the accumulated data storage area in the second compensation memory.

8. The timing controller according to claim 1, wherein at least one of the first compensation memory and the second compensation memory is a static random access memory (SRAM).

9. A display device comprising:

pixels disposed on intersections between scan lines and data lines;

a scan driver configured to supply scan signals to the scan lines;

a data driver configured to supply data signals to the data lines based on image data; and a timing controller configured to transmit the image data to the data driver, wherein the timing controller comprises:

a first compensator configured to generate second data by optically compensating for first data, based on compensation data;

a first compensation memory configured to store the compensation data;

a second compensator configured to generate the image data by compensating for a lifetime of the second data, based on accumulated data of the second data;

a second compensation memory configured to store the accumulated data and the compensation data; and a memory controller configured to set, in the first compensation memory, a first compensation data storage area for storing the compensation data, and set, in the second compensation memory, a second compensation data storage area for storing the compensation data and an accumulated data storage area for storing the accumulated data, wherein the memory controller reduces the second compensation data storage area as the accumulated data storage area increases.

10. The display device according to claim 9, wherein the compensation data includes a gray level and a compensation value for at least one compensation point.

11. The display device according to claim 10, wherein the memory controller reduces a number of bits of the compensation value as the accumulated data storage area increases.

* * * * *